US008042433B2

(12) United States Patent
Chu

(10) Patent No.: US 8,042,433 B2
(45) Date of Patent: Oct. 25, 2011

(54) REPLACEMENT STRUCTURE OF RATCHET WRENCH

(75) Inventor: Ching-Tseng Chu, Taichung (TW)

(73) Assignee: Jiutsang Limited, Taichung (TW)

( * ) Notice: Subject to any disclaimer, the term of this patent is extended or adjusted under 35 U.S.C. 154(b) by 225 days.

(21) Appl. No.: 12/493,254

(22) Filed: Jun. 29, 2009

(65) Prior Publication Data

US 2010/0326247 A1 Dec. 30, 2010

(51) Int. Cl.
*B25B 13/46* (2006.01)

(52) U.S. Cl. ..... 81/63.2; 81/60

(58) Field of Classification Search ..... 81/60–63, 81/63.1, 63.2

See application file for complete search history.

(56) References Cited

U.S. PATENT DOCUMENTS 2,978,081 A * 4/1961 Lundin ..... 192/43.1
3,659,484 A * 5/1972 Scodeller ..... 81/63
5,626,062 A * 5/1997 Colvin ..... 81/63.2
6,467,378 B1 * 10/2002 Chen ..... 81/60
7,082,861 B1 * 8/2006 Chen ..... 81/63.2
7,328,633 B2 * 2/2008 Lin ..... 81/63.1
2004/0134313 A1 * 7/2004 Liu ..... 81/63.2

* cited by examiner

*Primary Examiner* — David B Thomas

(74) *Attorney, Agent, or Firm* — Leong C. Lei

(57) ABSTRACT

A ratchet wrench includes a parts replacement structure that ensures effort-saved and smooth operation and prevents parts from getting lost. The wrench has a handle having an end forming a head portion that rotatably receives therein a driving collar. A lid plate is fixed to the head portion to retain a pawl member that engages and controls the rotation of the driving collar. The pawl member includes a pusher pad positioned on and movable along a top of the lid plate. A retention block is set at the side of the pawl member opposite to the driving collar to apply a biasing force to the pawl member through a push bar. In this arrangement, the push bar will not get lost when the pawl member disengages from and thus releases the driving collar for replacement.

19 Claims, 7 Drawing Sheets

REPLACEMENT STRUCTURE OF RATCHET WRENCH

(a)TECHNICAL FIELD OF THE INVENTION

The present invention generally relates to the field of ratchet wrench, and more particularly to a replacement structure of a ratchet wrench that allows ready and efficient replacement of parts of the ratchet wrench.

(b)DESCRIPTION OF THE PRIOR ART

A conventional ratchet wrench uses a driving collar, which is rotatably mounted in a head of the wrench and manually driven by a handle, to fit and engage a nut or a bolt and the driving collar is not removable from the wrench and is thus of a fixed size, making it not possible to meet various needs of different jobs.

Thus, a ratchet wrench with a replaceable driving collar, as shown in FIG. 1 of the attached drawings, is available in the market. The conventional ratchet wrench has a wrench handle 10 having a head portion 11 forming a recessed collar chamber 12 that rotatably receives therein a driving collar 20 having an outer circumferential surface forming ratcheting teeth 21. The collar chamber 12 has a bottom forming a support flange 120 and a circumferential wall forming a switching channel 13 adjacent to the handle 10. The switching channel 13 receives therein a pawl member 25 that forms ratcheting teeth 26. The switching channel 13 has an inner wall defining a hole 14 and the hole 14 receives therein a push bar 29 and a resilient biasing element 290. The head portion 11 has a top surface forming a recess 15 in which a lid plate 16 is fixed. The lid plate 16 forms an operation groove 17 having a bank forming a release notch 18. The pawl member 25 forms an operation bar 28. The driving collar 20 and the pawl member 25 respectively form a circumferential positioning groove 22 and a positioning peg 27 in central portions of opposing surfaces thereof for engagement with each other. Operating the operation bar 28 to move the pawl member 25 along the release notch 18 separates the positioning peg 27 and the circumferential positioning groove 22 from each other so as to allow the driving collar 20 to be removed for replacement of a new driving collar 20 of different specification.

However, this arrangement suffers operation problems. As shown in FIGS. 1 and 2, the positioning peg 27 is set in and engages the circumferential positioning groove 22 and due to machining precision, a bottom of the pawl member 25 may not be precisely positioned on and supported by the support flange 120, making the pawl member 25 suspending in the air. When the operation bar 28 is caused to move, the point of application of force and the push bar 29 form an arm of force application, making the pawl member 25 tilted in the direction where the force is applied to the operation bar 28 (as shown in FIG. 2). This may cause jamming and abrasion between the positioning peg 27 and the circumferential positioning groove 22, leading to undesired influence on convenience of parts replacement and shortening of lifespan.

Further, the circumferential positioning groove 22 and the positioning peg 27 are set in the central portions. Due to technical problems of machining, the ratcheting teeth 21, 26 of the driving collar 20 and the pawl member 25 may only be allowed for a reduced number and a reduced surface area. This causes clearance and improper engagement between opposing surfaces of the teeth, leading to tooth leaping, breaking of tooth, and insufficient strength for bearing torque.

Further, the pawl member 25 is constrained by the lid plate 16 so as not to detach in replacing the driving collar 20. This makes it not possible to form the operation groove 17 in an open configuration and thus limiting the feasible size of the operation bar 28 and affecting the strength and lifespan thereof. If the operation groove 17 is modified as an open form in the attempt to enlarge the diameter of the operation bar 28, then the pawl member 25 is no longer constrained and may get fallen when the driving collar 20 is being replaced, whereby the push bar 29 and the resilient biasing element 290 may detach from the wrench and get lost due to their small sizes, eventually leading to inconvenience in replacement and use.

SUMMARY OF THE INVENTION

The primary purpose of the present invention is to provide a ratchet wrench that facilitates effort-saving and operation smoothness in the movement of a pawl member so as to make replacement of a driving collar smooth and efficient.

Another objective of the present invention is to increase structural strength of the ratchet wrench for extending the lifespan thereof.

A further objective of the present invention is to eliminate the trouble of losing parts in order to make replacement operation easy and efficient.

To achieve the above objectives, the present invention provides a ratchet wrench, which comprises a parts replacement structure that ensures effort-saved and smooth operation and prevents parts from getting lost. The wrench has a handle having an end forming a head portion that rotatably receives therein a driving collar. A lid plate is fixed to the head portion to retain a pawl member that engages and controls the rotation of the driving collar. The pawl member includes a pusher pad positioned on and movable along a top of the lid plate. A retention block is set at the side of the pawl member opposite to the driving collar to apply a biasing force to the pawl member through a push bar. In this arrangement, the push bar will not get lost when the pawl member disengages from and thus releases the driving collar for replacement.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
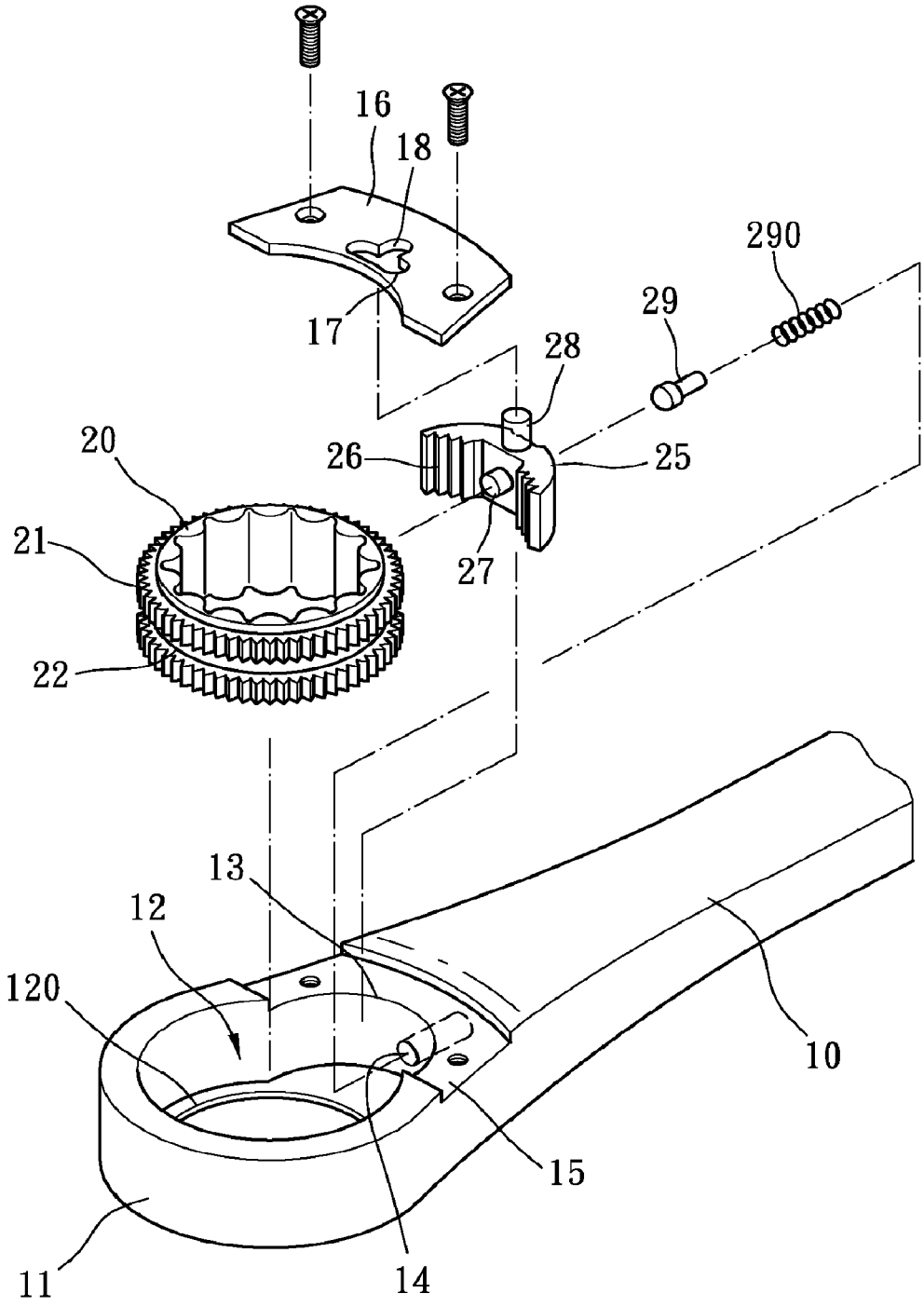
Fig. 1 PRIOR ART
FIG. 1 is an exploded view of a conventional ratchet wrench.
Figure 2:
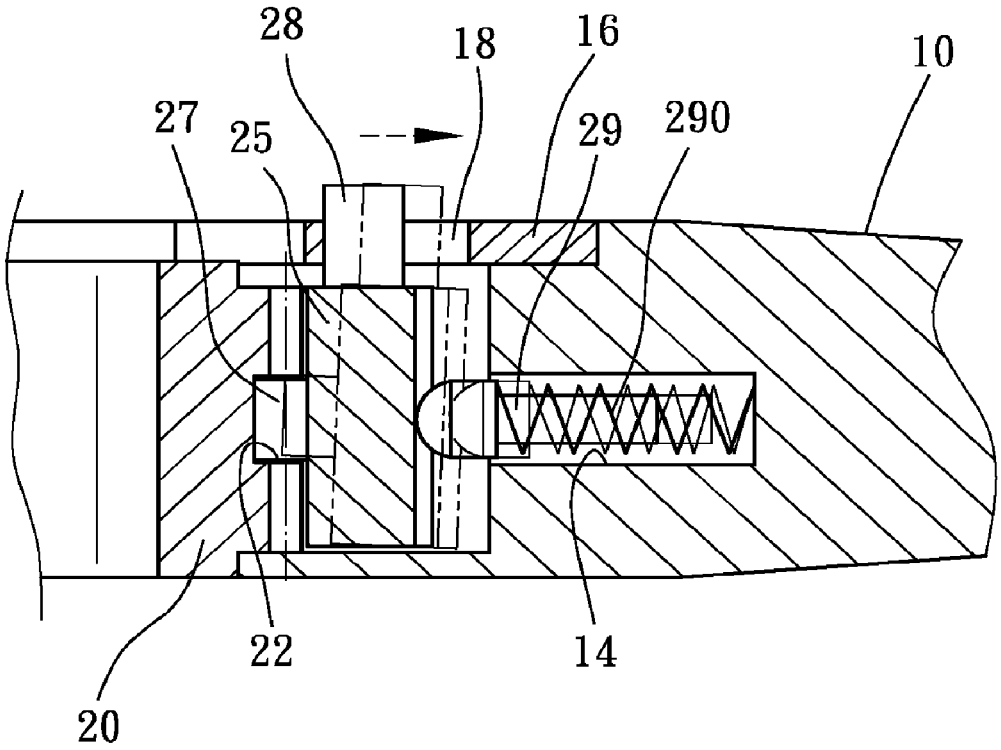
Fig. 2 PRIOR ART
FIG. 2 is a cross-sectional view of a portion of the conventional ratchet wrench.
Figure 3:
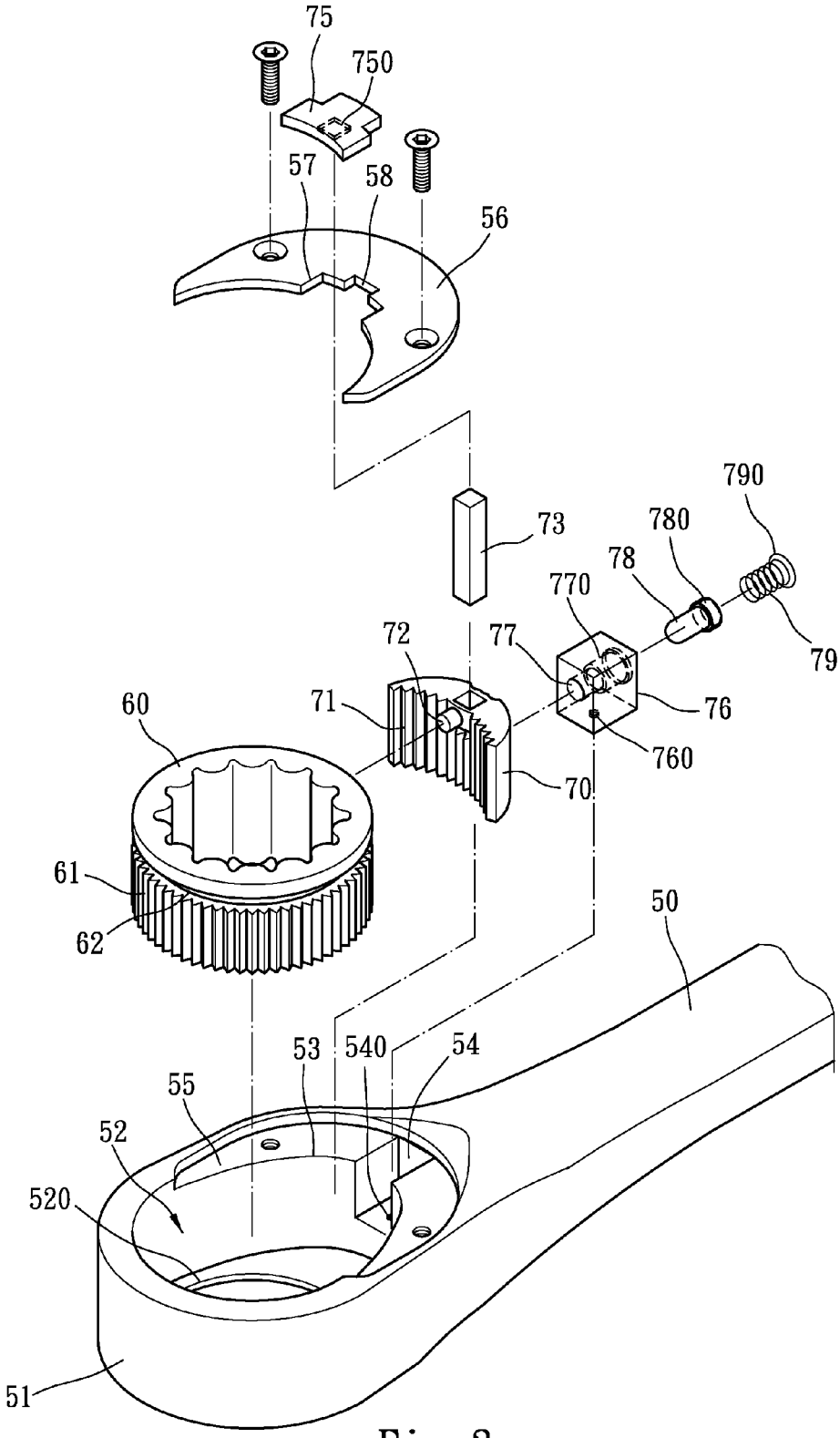
FIG. 3 is an exploded view of a ratchet wrench constructed in accordance with the present invention.
Figure 4:
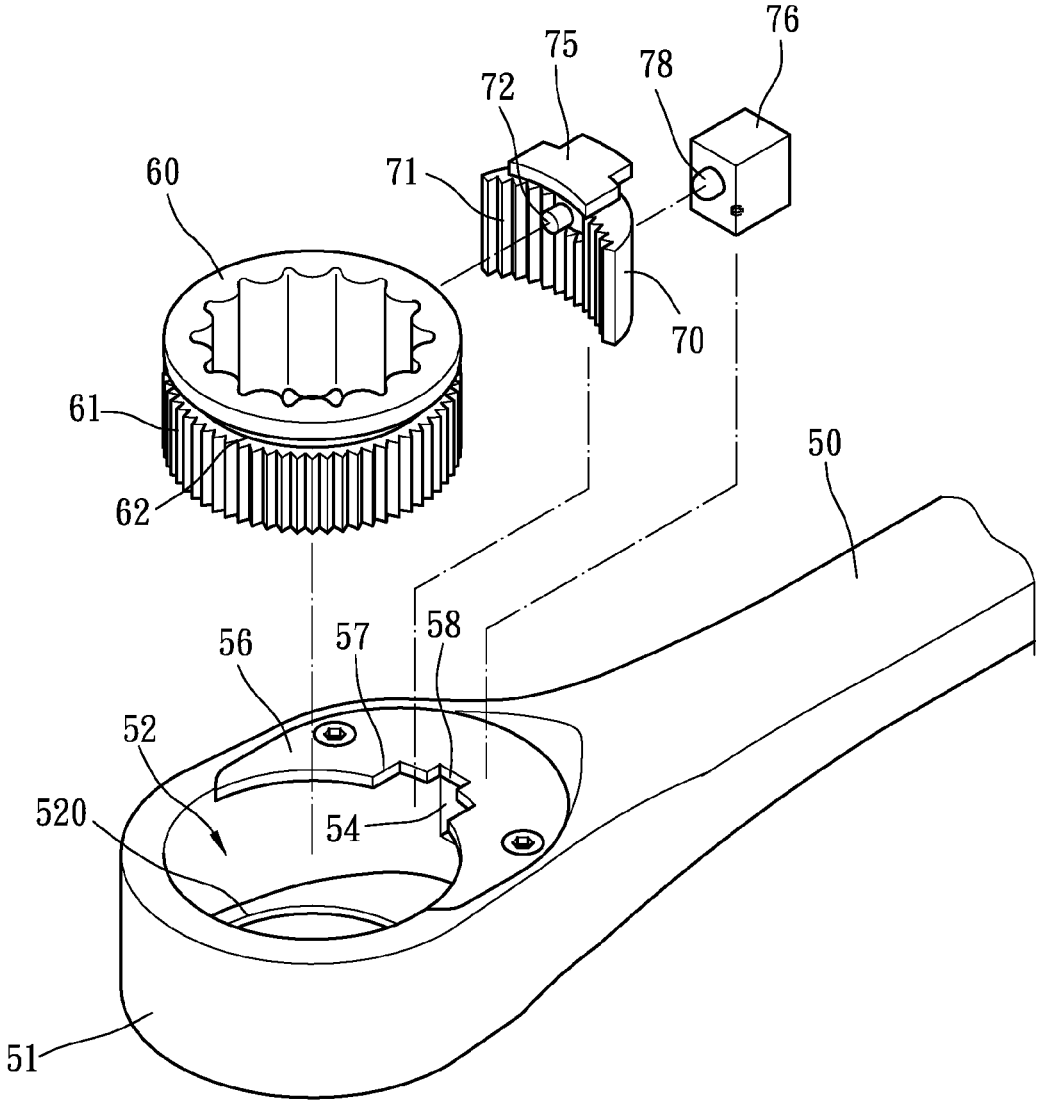
FIG. 4 is a perspective view of the ratchet wrench of the present invention in a partially assembled form.
Figure 5:
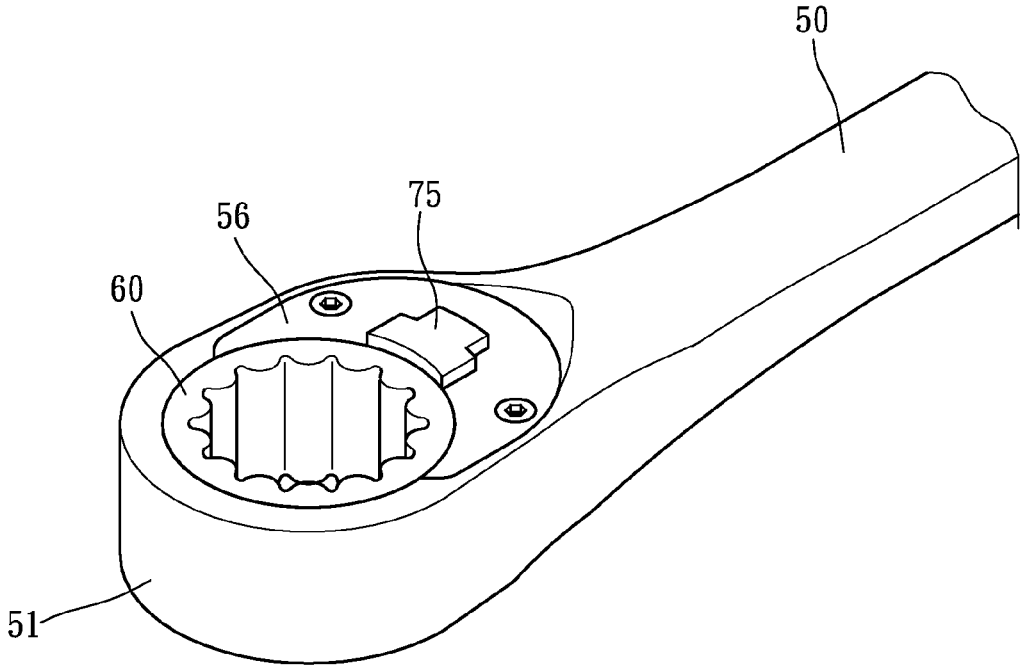
FIG. 5 is a perspective view of the ratchet wrench of the present invention in a completely assembled form.

As shown in FIGS. 3-5, a ratchet wrench in accordance with the present invention comprises a handle 50, a driving collar 60, and a pawl member 70.

The handle 50 has at least one end forming a head portion 51. The head portion 51 forms a collar chamber 52. The collar chamber 52 has a bottom forming a support flange 520 and a circumferential wall forming a switching channel 53 adjacent to the handle 50. The switching channel 53 receives therein the pawl member 70. The switching channel 53 has an inner wall defining a receiving slot 54 and the receiving slot 54 has a bottom in which a recessed positioning hole 540 is defined. The head portion 51 has a top surface forming a recess 55 in which a lid plate 56 is fixed. The lid plate 56 has an edge forming an operation cutoff 57 having an open side. The cutoff 57 has an inside wall opposite to the open side and forming a release notch 58.

The driving collar 60 has an inner circumference that is formed of a size and configuration corresponding to the specification of a designated nut and an outer circumferential surface forming ratcheting teeth 61 and also forming a circumferential positioning groove 62 at a location close to a top thereof, whereby a constraint point of the driving collar 60 is set close to the location of the pawl member 70 that receives force application for backward movement so that backward movement of the pawl member 70 will not cause tilting in a specific direction.

Figure 6:
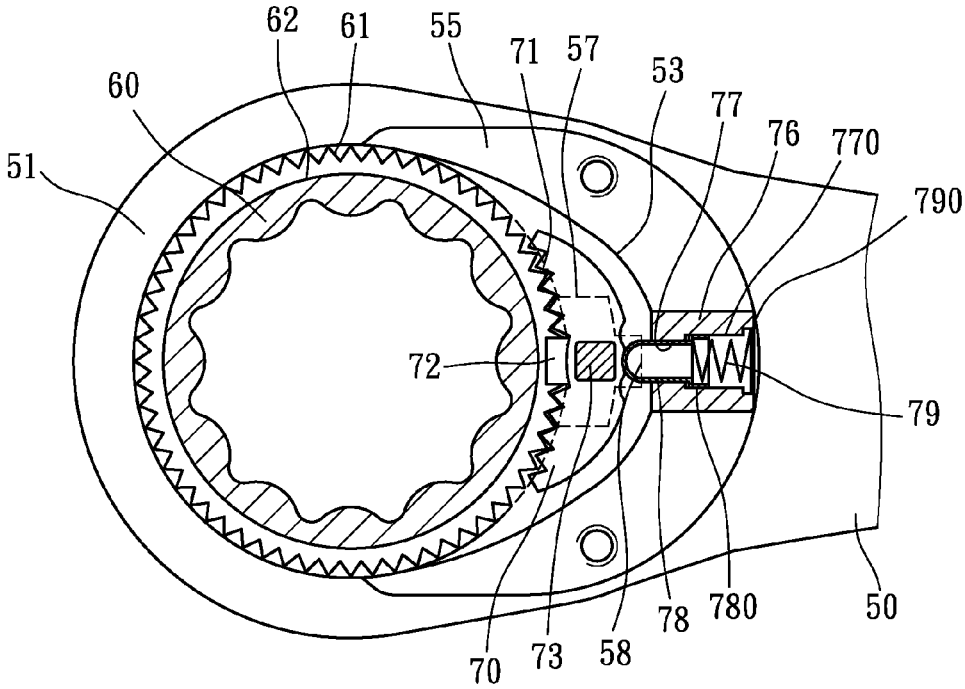
FIG. 6 is a top cross-sectional view of the ratchet wrench of the present invention.
Figure 8:
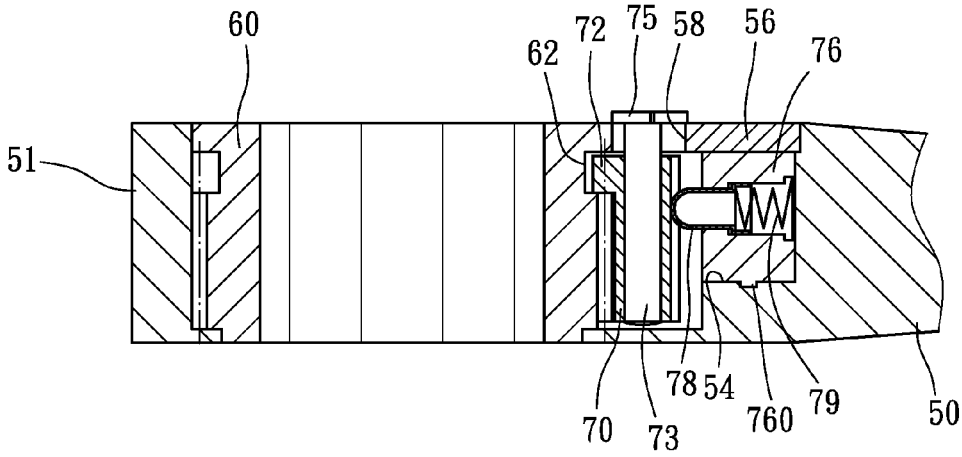
FIG. 8 is a side elevational cross-section of the ratchet wrench of the present invention.

As shown in FIGS. 6 and 8, the pawl member 70 forms ratcheting teeth 71 and comprises a positioning peg 72 adjacent to a top thereof. The top of the pawl member 70 is coupled to a pusher pad 75 that is slidably positioned on the lid plate 56 by a polygonal linking bar 73. The pusher pad 75 is positioned on a top surface of the lid plate 56 in such a way of being movable frontward/backward relative thereto. The pusher pad 75 has a bottom surface forming a mounting portion 750 corresponding to and coupled to the linking bar 73, whereby the pusher pad 75 is coupled to the pawl member 70, increasing the volume and force application area of the pawl member 70 and preventing the pawl member 70 from falling and getting lost and realizing saving of effort. The receiving slot 54 receives therein a retention block 76. The retention block 76 has a bottom forming a positioning boss 760 corresponding to and engaging the positioning hole 540. The retention block 76 forms therethrough a bore 77, which is set at a location higher than half of the height of the retention block 76. The bore 77 comprises a diameter-increased section 770 at the side opposite to the pawl member 70, and the bore 77 movably receives therein a push bar 78 having a corresponding step section 780. A resilient biasing element 79 is arranged between the push bar 78 and an inside wall for providing a pre-loaded returning force to the push bar 78 to bias the push bar 78 against the pawl member 70. A rear end of the resilient biasing element 79 forms a large-diameter positioning ring 790 for facilitating the installation of the resilient biasing element 79.

Figure 7:
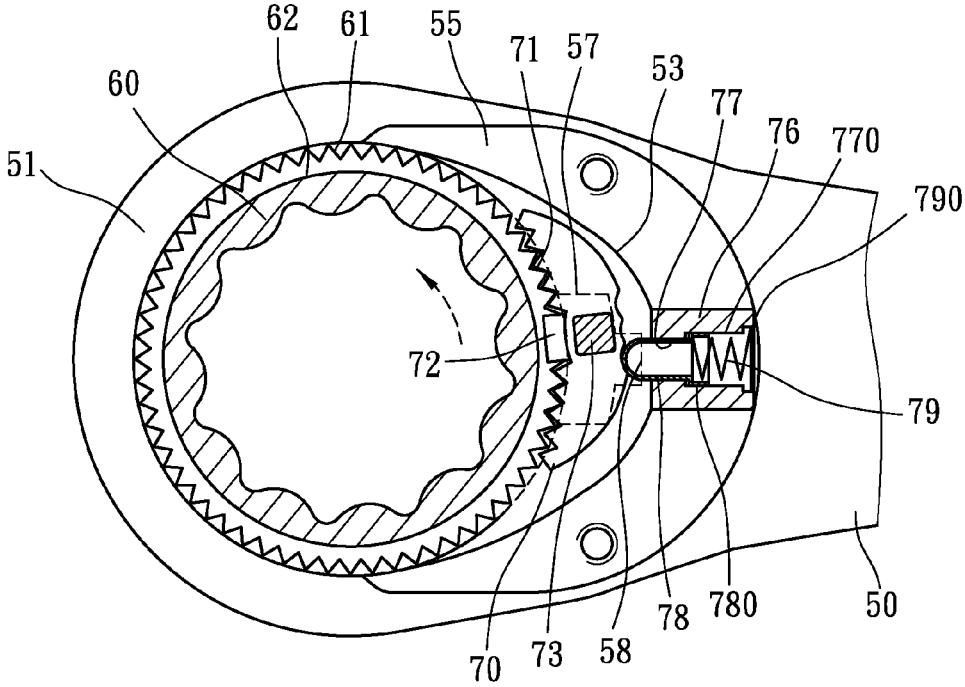
FIG. 7 is another top cross-sectional view of the ratchet wrench of the present invention illustrating adjustment of operation direction thereof.

As shown in FIGS. 5-7, to adjust operation direction, the pusher pad 75 is manually driven to move the pawl member 70 aside to realize one-way engagement with the driving collar 60, whereby the driving collar 60 may perform ratcheting operation that allows loaded rotation of the driving collar 60 in one direction and induces only idle rotation in the opposite direction.

Figure 9:
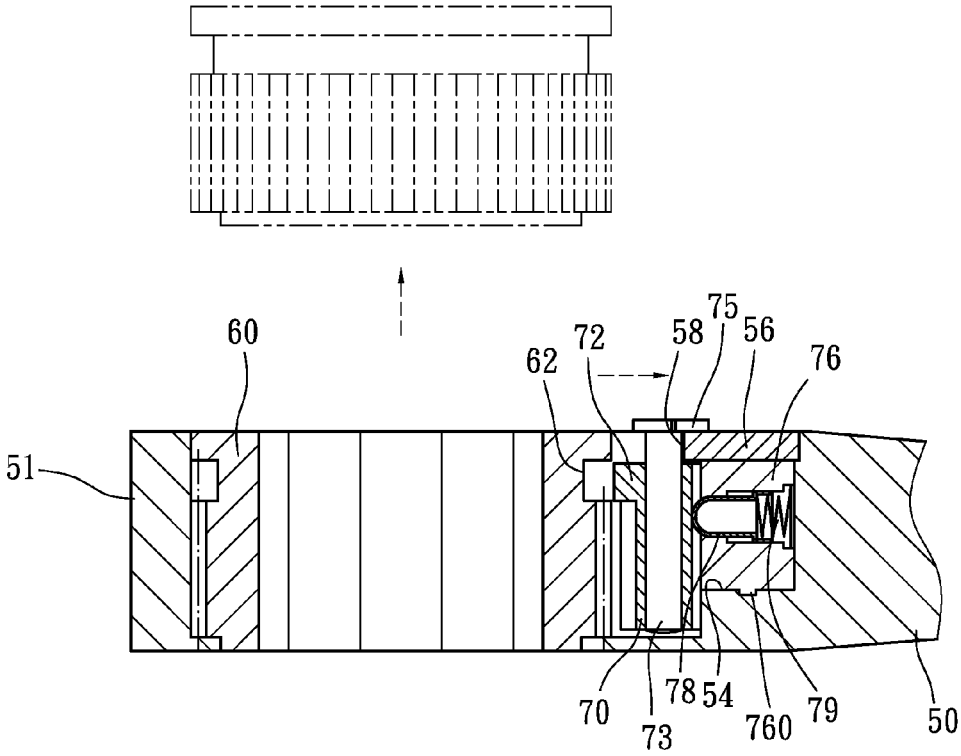
FIG. 9 is another side elevational cross-section of the ratchet wrench of the present invention, illustrating the operation of releasing a driving collar from the wrench.

To replace the driving collar 60, as shown in FIGS. 5, 8, and 9, the pusher pad 75 is moved on the surface of the lid plate 56 to have the pusher pad 75 located on the cutoff 57 and corresponding to the release notch 58 (see FIG. 5). The pusher pad 75 is then moved backward along the release notch 58, causing the pawl member 70 to simultaneously move backward and the positioning peg 72 separating from the circumferential positioning groove 62. Since the pusher pad 75 is moved by sliding along the top surface of the lid plate 56 and the constraint point of the driving collar 60 is set close to the pusher pad 75 that applies a force, the pawl member 70 does not tilt in a specific direction during and after the backward movement thereof (see FIG. 9). This tremendously improve effort saving and stability of the operation, whereby the driving collar 60 is allowed to withdraw upward for replacement with a different driving collar 60 having different specification. Afterwards, by releasing the pusher pad 75, the pawl member 70 is acted upon by the pre-loaded returning force provided by the resilient biasing element 79 that is applied through the push bar 78 to move toward the replacement driving collar 60 to allow the positioning peg 72 to re-engage the circumferential positioning groove 62, by which the replacement of the driving collar 60 is completed.

The improvement in efficacy includes:

(1) Operation can be done in a effort-saved, smooth, and stable manner. Since the pusher pad 75 is positioned on the top surface of the lid plate 56, the movement of the pawl member 70 is carried out in a supported manner. Force is applied through movement along top surface of the lid plate 56 (see FIGS. 8 and 9), so that jamming and abrasion of the positioning peg 72 and the circumferential positioning groove 62 can be eliminated. Thus, convenience and smoothness of the replacement of the driving collar 60 can be realized and the lifespan of the driving collar 60 is extended.

(2) The strength for bearing torque is enhanced. Since the circumferential positioning groove 62 and the positioning peg 72 are set at locations close to the top side, the ratcheting teeth 61, 71 are configured to realize full-surface engagement therebetween, which enhances the inter-engagement therebetween and prevents tooth leaping and breaking of tooth so as to enhance the strength for bearing torque.

(3) Reliability is improved. Since the positioning peg 72 is set close to the top side, the number of the ratcheting teeth 71 can be increased and no discontinuity exists, so as to ensure reliable engagement.

(4) The lifespan is extended. Since the operation cutoff 57 is set in an open configuration, the diameter of the linking bar 73 may be increased, so as to possess better structural strength as compared to the conventional structure, whereby the lifespan can be extended.

(5) Parts do not get lost. The pawl member 70 is combined with the pusher pad 75 to increase the total volume thereof, and the push bar 78 and the resilient biasing element 79 are retained in the retention block 76, so that they are not allowed to get separated, whereby losing parts is not possible and the convenience of the replacement operation is enhanced.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A ratchet wrench, comprising:

a handle having at least one end forming a head portion, the head portion forming a hollow collar chamber having a bottom forming a support flange, the collar chamber having a circumferential wall forming a switching channel, the switching channel having an inner wall defining a receiving slot, the head portion having a top surface to which a lid plate is fixed, the lid plate having an edge forming a one-side open operation cutoff, the cutoff having an opposite wall forming a release notch;

a driving collar, which is received in the collar chamber and positioned on the support flange, the driving collar having an outer circumferential surface forming a plurality of ratcheting teeth, the driving collar forming a circumferential positioning groove in the outer circumferential surface at a location close to a top thereof; and a pawl member, which is received in the switching channel and forms a plurality of ratcheting teeth engageable with the driving collar, the pawl member forming a positioning peg corresponding to the circumferential positioning groove in a middle portion close to a top thereof, the top of the pawl member being coupled through a linking bar to a pusher pad that is positioned on and movable along a top surface of the lid plate, a retention block being received in the receiving slot, the retention block forming a bore that comprises a rear section forming an inner shoulder, the bore movably receiving therein a push bar having a step section, a resilient biasing element being arranged between the push bar and an inside wall.

2. The ratchet wrench according to claim 1, wherein the receiving slot has a bottom in which a recessed positioning hole is defined and wherein the retention block has a bottom forming a positioning boss corresponding to and engaging the positioning hole.

3. The ratchet wrench according to claim 1, wherein the linking bar has a polygonal cross-section and wherein the pusher pad has a bottom surface forming a mounting portion corresponding to and coupled to the linking bar.

4. The ratchet wrench according to claim 1, wherein the resilient biasing element has a rear end forming a large-diameter positioning ring.

5. The ratchet wrench according to claim 1, wherein the bore is set at a location higher than half of height of the retention block.

6. A ratchet wrench, comprising:

a handle having at least one end forming a head portion, the head portion forming a hollow collar chamber having a bottom forming a support flange, the collar chamber having a circumferential wall forming a switching channel, the switching channel having an inner wall defining a receiving slot, the head portion having a top surface to which a lid plate is fixed, the lid plate having an edge forming a one-side open operation cutoff, the cutoff having an opposite wall forming a release notch;

a driving collar, which is received in the collar chamber and positioned on the support flange, the driving collar having an outer circumferential surface forming a plurality of ratcheting teeth, the driving collar forming a circumferential positioning groove in the outer circumferential surface; and a pawl member, which is received in the switching channel and forms a plurality of ratcheting teeth engageable with the driving collar, the pawl member forming a positioning peg corresponding to the circumferential positioning groove, a top of the pawl member forming a linking bar extending beyond the lid plate, a retention block being received in the receiving slot, the retention block forming a bore that comprises a rear section forming an inner shoulder, the bore movably receiving therein a push bar having a step section, a resilient biasing element being arranged between the push bar and an inside wall.

7. The ratchet wrench according to claim 6, wherein the receiving slot has a bottom in which a recessed positioning hole is defined and wherein the retention block has a bottom forming a positioning boss corresponding to and engaging the positioning hole.

8. The ratchet wrench according to claim 6, wherein the resilient biasing element has a rear end forming a large-diameter positioning ring.

9. The ratchet wrench according to claim 6, wherein the circumferential groove is formed in the outer circumferential surface of the driving collar at a location close to a top thereof and wherein the positioning peg is formed at a corresponding location of the pawl member close to the top thereof.

10. The ratchet wrench according to claim 9, wherein the bore is set at a location higher than half of height of the retention block.

11. The ratchet wrench according to claim 6, wherein the bore is set at a location higher than half of height of the retention block.

12. The ratchet wrench according to claim 6, wherein the linking bar is coupled to a pusher pad that is positioned on and movable along a top surface of the lid plate.

13. The ratchet wrench according to claim 12, wherein the linking bar has a polygonal cross-section and wherein the pusher pad has a bottom surface forming a mounting portion corresponding to and coupled to the linking bar.

14. A ratchet wrench, comprising:

a handle having at least one end forming a head portion, the head portion forming a hollow collar chamber having a bottom forming a support flange, the collar chamber having a circumferential wall forming a switching channel, the head portion having a top surface to which a lid plate is fixed, the lid plate having an edge forming an operation cutoff, the cutoff having an inside wall forming a release notch;

a driving collar, which is received in the collar chamber and positioned on the support flange, the driving collar having an outer circumferential surface forming a plurality of ratcheting teeth, the driving collar forming a circumferential positioning groove in the outer circumferential surface; and a pawl member, which is received in the switching channel and forms a plurality of ratcheting teeth engageable with the driving collar, the pawl member forming a positioning peg corresponding to the circumferential positioning groove, the top of the pawl member being coupled through a linking bar to a pusher pad that is positioned on and movable along a top surface of the lid plate, the handle having an inside surface supporting a push bar at a rear side of the pawl member, a resilient biasing element being arranged between the push bar and an inside wall;

wherein the linking bar has a polygonal cross-section and wherein the pusher pad has a bottom surface forming a mounting portion corresponding to and coupled to the linking bar.

15. The ratchet wrench according to claim 14, wherein the circumferential groove is formed in the outer circumferential surface of the driving collar at a location close to a top thereof and wherein the positioning peg is formed at a corresponding location of the pawl member close to the top thereof.

16. The ratchet wrench according to claim 14, wherein the switching channel having an inner wall defining a receiving slot that receives therein a retention block, the retention block forming a bore that comprises a rear section forming an inner shoulder, the bore movably receiving therein the push bar having a step section, the resilient biasing element being arranged between the push bar and an inside wall.

17. The ratchet wrench according to claim 16, wherein the cutoff is formed in an open configuration.

18. The ratchet wrench according to claim 16, wherein the bore is set at a location higher than half of height of the retention block.

19. The ratchet wrench according to claim 16, wherein the receiving slot has a bottom in which a recessed positioning hole is defined and wherein the retention block has a bottom forming a positioning boss corresponding to and engaging the positioning hole.

* * * * *